US009624002B2

(12) United States Patent
Fietz

(10) Patent No.: US 9,624,002 B2
(45) Date of Patent: Apr. 18, 2017

(54) BEVERAGE CAN HANDLE

(71) Applicant: The Fietz Family Trust, Calgary (CA)

(72) Inventor: Guy Fietz, Calgary (CA)

(73) Assignee: The Fietz Family Trust, Calgary (CA)

( * ) Notice: Subject to any disclaimer, the term of this patent is extended or adjusted under 35 U.S.C. 154(b) by 0 days.

(21) Appl. No.: 14/441,123

(22) PCT Filed: Nov. 26, 2013

(86) PCT No.: PCT/CA2013/050905
§ 371 (c)(1),
(2) Date: May 6, 2015

(87) PCT Pub. No.: WO2014/082174
PCT Pub. Date: Jun. 5, 2014

(65) Prior Publication Data

US 2015/0291316 A1 Oct. 15, 2015

Related U.S. Application Data

(60) Provisional application No. 61/730,315, filed on Nov. 27, 2012.

(51) Int. Cl.
*B65D 25/28* (2006.01)
*A47G 19/22* (2006.01)
*A47G 23/02* (2006.01)

(52) U.S. Cl.
CPC ..... *B65D 25/2829* (2013.01); *A47G 19/2205* (2013.01); *A47G 23/0266* (2013.01);
(Continued)

(58) Field of Classification Search
CPC ..... A47G 23/0266; B65D 25/2829; B65D 25/2832; B65D 2525/285;
(Continued)

(56) References Cited

U.S. PATENT DOCUMENTS 896,133 A 8/1908 Mayer
1,632,639 A * 6/1927 Weise ..... A45B 19/04 135/75
(Continued)

FOREIGN PATENT DOCUMENTS

FR 522519 A 8/1921
FR 1388785 A 2/1965

OTHER PUBLICATIONS

International Patent Application No. PCT/CA2013/050905, International Search Report dated Feb. 10, 2014.
(Continued)

*Primary Examiner* — Anthony Stashick
*Assistant Examiner* — Mollie Impink
(74) *Attorney, Agent, or Firm* — Borden Ladner Gervais LLP; Jason R. Mueller-Neuhaus

(57) ABSTRACT

A beverage can handle includes a first arm having a first end and a second end. The first end includes a protrusion for supporting a first lip of a beverage can. The protrusion is shaped for inhibiting slippage of the first lip of the beverage can off of the protrusion. The beverage can handle also includes a second arm that is slideably coupled to the first arm and extendable from a storage position to an extended position relative to the first end of the first arm. The second arm has a first end and a second end. The first end includes a groove for releasably mating with a second lip of the beverage can when in the extended position. The groove is shaped for inhibiting slippage of the second lip of the beverage can out of the groove when the second arm is in the extended position.

11 Claims, 16 Drawing Sheets

(52) U.S. Cl.
CPC .. *B65D 2525/285* (2013.01); *B65D 2525/286* (2013.01); *B65D 2525/287* (2013.01)

(58) Field of Classification Search
CPC ..... B65D 2525/286; B65D 2525/287; B65D 23/10; B65D 23/104; Y10T 16/469; Y10T 16/4707; Y10T 16/473; Y10T 16/4719; Y10T 16/4713
USPC ..... 220/710.5, 759, 768, 769
See application file for complete search history.

(56) References Cited

U.S. PATENT DOCUMENTS

| | | | | | |
|---|---|---|---|---|---|
| 2,010,317 | A * | 8/1935 | Olson | A47G 23/0266 | 220/742 |
| 2,396,479 | A | 3/1946 | Votaw | | |
| 2,559,190 | A * | 7/1951 | Hallstream | A47G 23/0266 | 294/34 |
| 2,665,936 | A | 1/1954 | Moore | | |
| 2,717,171 | A * | 9/1955 | Gottstein | A45F 5/10 | 294/166 |
| 2,838,202 | A * | 6/1958 | Huether | A47G 23/0266 | 220/741 |
| 3,024,057 | A | 3/1962 | Lockwood | | |
| 3,189,937 | A | 6/1965 | Sciortino | | |
| D204,295 | S | 4/1966 | Brekke | | |
| 3,261,635 | A | 7/1966 | Talay | | |
| 3,638,801 | A * | 2/1972 | Larson | A47F 5/0823 | 211/162 |
| D232,614 | S | 9/1974 | Brown | | |
| 3,979,011 | A * | 9/1976 | Schleicher | A47G 23/0266 | 220/287 |
| 4,127,915 | A | 12/1978 | Logan et al. | | |
| D251,766 | S | 5/1979 | Hammerschmidt | | |
| 4,602,723 | A | 7/1986 | DeMars | | |
| D303,336 | S | 9/1989 | Webster | | |
| 4,898,297 | A | 2/1990 | Wheeler | | |
| 5,054,638 | A | 10/1991 | Rose | | |
| 5,101,998 | A * | 4/1992 | Hwang | F23D 14/38 | 215/395 |
| 5,505,330 | A | 4/1996 | Nunes | | |
| 6,102,458 | A | 8/2000 | Scace | | |
| 6,266,849 | B1 * | 7/2001 | Petit | B44D 3/14 | 16/425 |
| 6,640,395 | B2 * | 11/2003 | Bush | B60J 11/00 | 24/68 CD |
| 2010/0282767 | A1 | 11/2010 | Wren | | |

OTHER PUBLICATIONS

U.S. Appl. No. 29/496,834, Notice of Allowance dated Oct. 20, 2015.
Chinese Patent Application No. 201380058508.0 English Translation of Office Action dated Apr. 25, 2016.
Extended European Search Report for Application No. EP13858264, mailed on Sep. 20, 2016, 10 Pages.

* cited by examiner

BEVERAGE CAN HANDLE

CROSS REFERENCE TO RELATED APPLICATIONS

This application claims the benefit of priority of U.S. Provisional Patent Application No. 61/730,315 filed Nov. 27, 2012, which is incorporated herein by reference in its entirety.

FIELD

The present disclosure generally relates to handles. More particularly, the present disclosure relates to a handle for attachment to a beverage can.

BACKGROUND

Beverage can handles facilitate holding of a beverage can by a user so that a hand of a user does not come into contact with the beverage can, which can cause unnecessarily warming or cooling of a beverage stored inside the can.

Known beverage can handles, such as those described in U.S. Pat. No. 3,261,635, U.S. Pat. No. 4,602,723, U.S. Pat. No. 5,054,638, and U.S. Pat. No. 5,505,330, have a "D" shape to provide a space between a hand of a user and a body of the beverage can when the handle is attached to the beverage can. These known D-shaped handles are generally one-piece and are sized such that a height of the handle is at least the same height as the beverage can. The storage and transport of known D-shaped beverage can handles is relatively cumbersome due to the size of these handles.

Improvements to beverage can handles are therefore desirable.

SUMMARY

According to one aspect there is provided, a beverage can handle comprising a first arm having a first end and a second end, the first end including a protrusion for supporting a first lip of a beverage can and shaped for inhibiting slippage of the first lip of the beverage can off of the protrusion; and a second arm slideably coupled to the first arm and extendable from a retracted position to an extended position relative to the first end of the first arm, the second arm having a first end and a second end, the first end comprising a groove for releasably mating with a second lip of the beverage can when in the extended position and shaped for inhibiting slippage of the second lip of the beverage can out of the groove when in the extended position.

According to another aspect there is provided, a beverage can handle comprising a body, a first retractable arm, connected to the body by articulating segments arranged in a telescopic configuration, and slideable from a retracted position, away from the body into an extended position upon acutation of a trigger mechanism, having a groove for releasably mating with the first lip of the beverage can, a second retractable arm connected to the body by articulating segments arranged in a telescopic configuration, and slideable from a retracted position, away from the body into an extended position upon actuation of a trigger mechanism. The second retractable arm has a groove for releasably mating with the second lip of the beverage can, the body and the retractable arms having a compressible biasing means for forcing the retractable arms away from the body into the extended position after actuation of the trigger mechanism.

BRIEF DESCRIPTION OF THE DRAWINGS

Embodiments of the present disclosure will be described, by way of example, with reference to the drawings and to the following description, in which.

DETAILED DESCRIPTION

Figure 1:
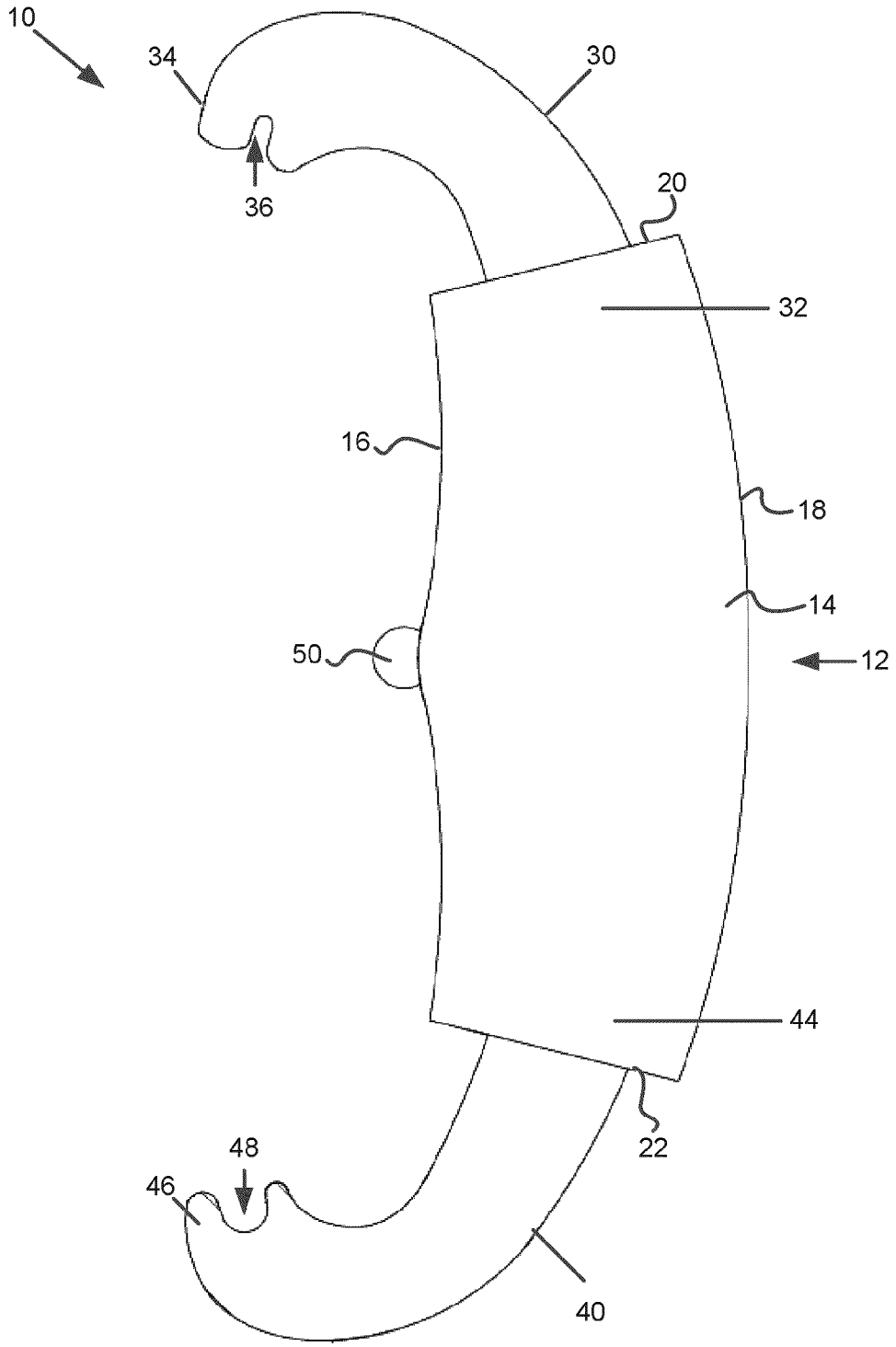
FIG. 1 is a side view of a beverage can handle in accordance with an embodiment, in which the beverage can handle is in a storage position.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures and components have not been described in detail to avoid obscuring the embodiments described. The description is not to be considered as limited to the scope of the embodiments described herein.

A beverage can handle includes a first arm having a first end and a second end. The first end includes a protrusion for supporting a first lip of a beverage can. The protrusion is shaped for inhibiting slippage of the first lip of the beverage can off of the protrusion. The beverage can handle also includes a second arm that is slideably coupled to the first arm and extendable from a storage position to an extended position relative to the first end of the first arm. The second arm has a first end and a second end. The first end includes a groove for releasably mating with a second lip of the beverage can when in the extended position. The groove is shaped for inhibiting slippage of the second lip of the beverage can out of the groove when the second arm is in the extended position.

The disclosure generally relates to a beverage can handle for attachment to a single beverage can, for example a soda can, a beer can, or a juice can.

Figure 2:
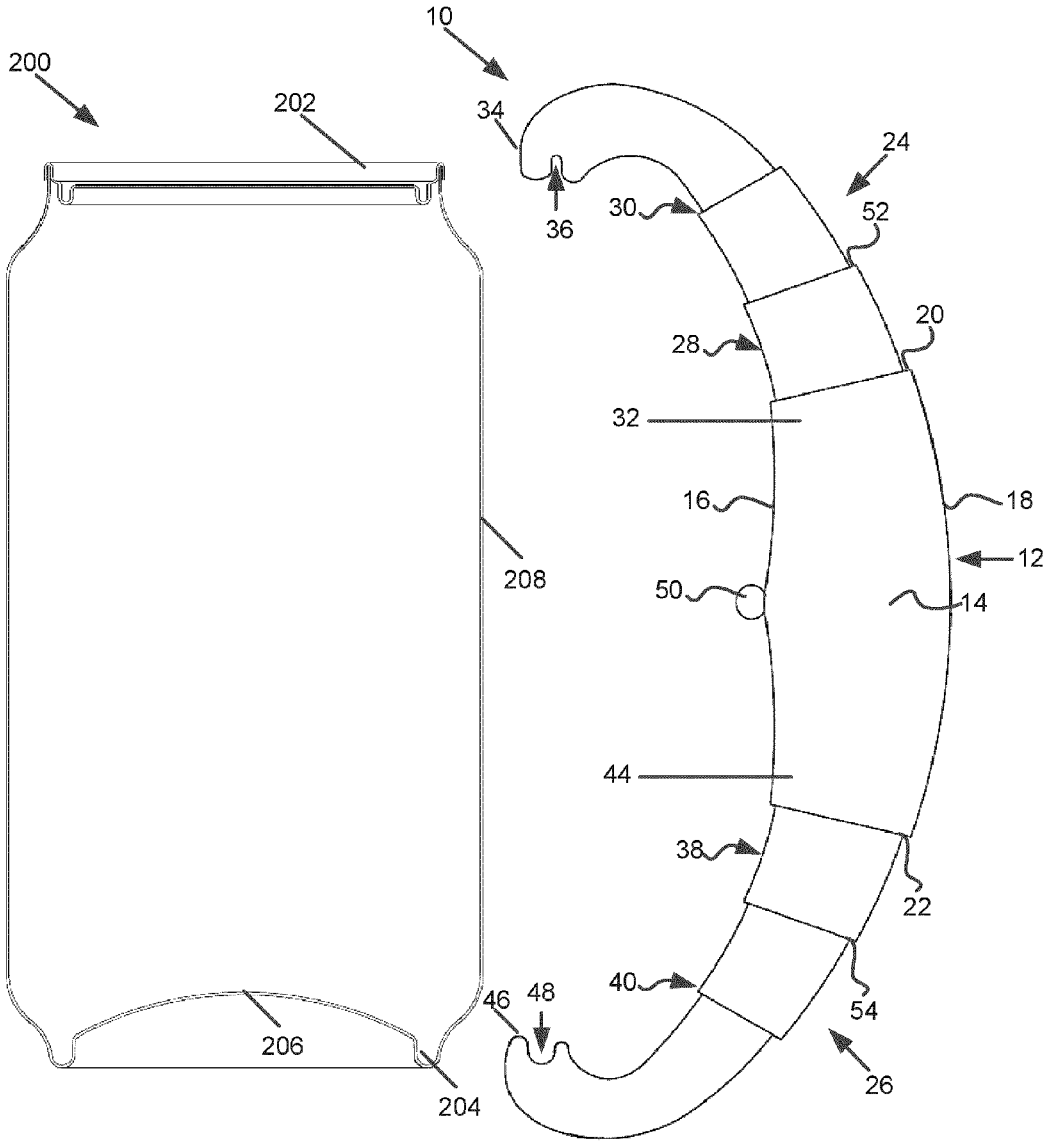
FIG. 2 is a side view of the beverage can handle of FIG. 1, in which the beverage can handle is in an extended position.

FIG. 1 and FIG. 2 show side views an example embodiment of a beverage can handle 10. The beverage can handle 10 includes a grip 12 that has body 14. The body 14 is hollow and is shaped and sized to facilitate grasping and holding of the grip 12 by a hand of a user. The grip 12 has a front 16, a back 18, a top 20, and a bottom 22. The grip 12 may be made from any suitable rigid material, such as, for example, plastic. The body 14 of the grip 12 may have a smooth surface. Alternatively, the body 14 may have grooves (not shown), such as pistol grip grooves, that are shaped and sized to receive a user fingers to facilitate the grasping and holding of the grip 12 by the user. Optionally, the front 12 of the grip 12 may have ring for attachment to a key ring or key chain, or an aperture that is shaped and dimensioned to receive and retain a key ring or key chain. A vertical axis, referred to herein, extends from the top 20 of the body 14 to the bottom 22 of the body 14 with respect to the orientation shown in FIG. 1.

The beverage can handle 10 also has a upper retractable arm 24 that extends from the top 20 of the body 14 and a lower retractable arm 26 that extends from the bottom 22 of the body 12. The upper and lower retractable arms 24, 26 may be made of any suitable resilient material, for example, plastic. The upper retractable arm 24 is connected to the body 14 of the grip 12 by an upper compressible biasing means (not shown). The upper compressible biasing means pushes or forces the upper retractable arm 24 to slide in a direction away from the top 20 of the body 14 to slide the upper retractable arm 24 from a storage position (FIG. 1) to an extended position (FIG. 2). The upper compressible biasing means also compresses to slide the upper retractable arm 24 in a direction toward the top 20 of the body 14 from the extended position (FIG. 2) to the storage position (FIG. 2), where the upper retractable arm 24 is locked or held in place by a trigger mechanism. The lower retractable arm 26 is also connected to the body 14 of the grip 12 by a lower compressible biasing means (not shown). The lower compressible biasing means pushes or forces the lower retractable arm 26 to slide in a direction away from the bottom 22 of the body 14 to slide the lower retractable arm 26 from a storage position (FIG. 1) to an extended position (FIG. 2). The lower compressible biasing means also compresses to slide the lower retractable arm 26 in a direction toward the bottom 22 of the body 14 from the extended position (FIG. 2) to the storage position (FIG. 2), where the lower retractable arm 26 is locked or held in place by the trigger mechanism.

The upper retractable arm 24 includes nested segments 28, 30. The segment 30 is housed or nested within the segment 28. The segment 28 is housed or nested within an open upper portion 32 of the body 14 of the grip 12. The segment 30 slides within the segment 28, and the segment 28 slides within the open upper portion 32 in a telescoping manner. The nested segments 28, 30 together form articulating segments.

In the embodiment shown in FIG. 1 and FIG. 2, the segment 30 has two parts that are fixed together (i.e., do not slide relative to each other). Alternatively, the upper segment 30 may have a single part that has a uniform width. An upper end 34 of the segment 30 has a groove 36 that is shaped and dimensioned to releasably mate with a top lip or rim 202 of a beverage can 200 to inhibit slippage of the top lip or rim 202 when the upper retractable arm 24 is in the extended position. Alternatively, upper end 34 of the segment 30 may have a protrusion (not shown) that extends in a direction toward the top 20 of the body 14. The protrusion may be shaped and dimensioned to inhibit slippage of the protrusion off of the top lip 202 of the beverage can 200. The upper end 34 of the segment 30 of the upper retractable arm 24 has a width (not shown) that is sufficient to inhibit rolling of the beverage can 10 when the beverage can handle 10 is attached to the beverage can 10 and tilted for drinking.

The open upper portion 32 of the body 14 has an upper internal flange (not shown) and the segment 28 has a lower internal flange (not shown) for abutting against the upper internal flange (not shown) of the open upper portion 32 to stop the travel of the segment 28 when the upper retractable arm 24 slides in a direction away from the top 20 of the body 14. The segment 28 also has an upper internal flange (not shown) and the segment 30 also has lower internal flange (not shown) for abutting against the upper internal flange (not shown) of the segment 28 to stop the travel of the segment 30 when the upper retractable arm 24 slides in a direction away from the top 20 of the body 14.

The lower retractable arm 26 includes nested segments 38, 40. The segment 40 is housed or nested within the segment 38. The segment 38 is housed or nested within an open lower portion 44 of the body 14 of the grip 12. The segment 40 slides within the segment 38, and the segment 38 slides within the open lower portion 44 in a telescoping manner. The nested segments 38, 40 together form articulating segments.

In the embodiment shown in FIG. 1 and FIG. 2, the segment 40 includes two parts that are fixed together (i.e., do not slide relative to each other). A lower end 46 of the segment 40 has a groove 48 that is shaped and dimensioned to releasably mate with a projection 204 extending from a base 206 of the beverage can 200 when the lower retractable arm 26 is in the extended position. Alternatively, the lower end 46 of the lower segment 40 may have a projection (not shown) that is shaped and dimensioned for pressing and holding against the base 206 of a beverage can 200 when the lower retractable arm 26 is in the extended position. The lower end 46 of the segment 40 of the lower retractable arm 26 has a width (not shown) that is sufficient to inhibit rolling of the beverage can 10 when the beverage can handle 10 is attached to the beverage can 10 and tilted for drinking.

The open lower portion 44 of the body 14 has an upper internal flange (not shown) and the segment 38 has an upper internal flange (not shown) for abutting against the upper internal flange (not shown) of the open lower portion 44 to stop the travel of the segment 38 when the lower retractable arm 26 slides in a direction away from the bottom 22 of the body 14. The segment 38 also has an lower internal flange (not shown) and the segment 40 also has an upper internal flange (not shown) for abutting against the lower internal flange (not shown) of the segment 38 to stop the travel of the lower segment 40 of the lower retractable arm 26 when the lower retractable arm 26 slides in a direction away from the bottom 22 of the body 14.

Although the upper and lower retractable arms 24, 26 shown in FIG. 1 and FIG. 2 each include two nested segments, the upper and lower retractable arms 24, 26 may include any suitable number of nested segments. For example, the upper and lower arms 24, 26 may each include a single segment that is nested within the open upper portion 32 and the open lower portion 44, respectively. Alternatively, the upper and lower retractable arms 24, 26 may include multiple nested segments to extended overall height or length of the beverage can handle for taller beverage cans while maintaining compact storage of the beverage can handle 10.

Referring again to FIG. 1, the beverage can handle 10 also includes a trigger mechanism (not shown) that is disposed in the body 14 of the grip 12. The trigger mechanism locks or holds the upper and lower retractable arms 24, 26 in the storage position. The trigger mechanism is actuatable by a depressible button 50. Further details of the trigger mechanism are described below with reference to FIG. 3 and FIG. 4.

Referring again to FIG. 1 and FIG. 2, the upper retractable arm 24, the body 14, and the lower retractable arm 26 each have a generally arcuate shape. Alternatively, the upper retractable arm 24, the body 14, and the lower retractable arm 26 collectively form an arcuate shape when in the extended position. In the embodiment shown in FIG. 1, the upper retractable arm 24, the grip 12, the lower retractable arm 26 together form a substantially D-shaped beverage can handle 10 such that when the upper retractable arm 24 and the lower retractable arm 26 are both in the extended position, the back 18 of grip 12 of the beverage can handle 10 is horizontally spaced from a body 208 of the beverage can 200. The generally arcuate shape of the upper retractable arm 24, the body 14, and the lower retractable arm 26 provides a space between the body 208 of the beverage can and the back 18 of the grip 12 for clearance of a user's fingers when grasping the body 14 of the grip 12.

The operation of the beverage can handle 10 will now be described with reference to FIG. 1 and FIG. 2. For the following description, the upper and lower retractable arms 24, 26 are assumed to begin in the storage position (FIG. 1). When the depressible button 50 is pressed by a user, the trigger is actuated and the upper and lower retractable arms 24, 26 are unlocked. When the upper and lower retractable arms 24, 26 are unlocked, the upper and lower compressible biasing means decompress. The decompression of the upper biasing means causes the upper retractable arm 24 to slide in a direction away from the top 20 of the body 14 from the storage position (FIG. 1) to the extended position (FIG. 2). Similarly, the decompression of the lower compressible biasing means causes the lower retractable arm 26 to slide in a direction away from the bottom 22 of the body 14 from the storage position (FIG. 1) to the extended position (FIG. 2).

As the upper retractable arm 24 slides in a direction away from the top 20 of the body 14, the segment 28 of the upper retractable arm 24 slides out of the open upper portion 32 of the body 14, and the segment 30 of the upper retractable arm 24 slides out of the segment 28 until the upper retractable arm 24 is in the extended position (FIG. 2). In the extended position (FIG. 2), the segment 28 of upper retractable arm 24 extends from the top 20 of the body 14 in a direction away from the top 20 of the body 14, and the segment 30 extends from a top 52 of the segment 28 in a direction away from the top 52 of the segment 28.

Similarly, as the lower retractable arm 26 slides in a direction away from the bottom 22 of the body 14, the segment 38 slides out of the open bottom portion 44 of the body 14, and the segment 40 slides out of the segment 38 until the lower retractable arm 26 is in the extended position (FIG. 2). In the extended position (FIG. 2), the segment 38 of the lower retractable arm 26 extends from the bottom 22 of the body 12 in a direction away from the bottom 22 of the body 14, and the segment 40 extends from a bottom 54 of the segment 38 in a direction away from the bottom 54 of the segment 38.

The upper retractable arm 24 may be returned from the extended position (FIG. 2) to the storage position (FIG. 1) by pressing on the upper retractable arm 24 to compress the top compression biasing means. Compressing the upper compressible biasing means causes the upper retractable arm 24 to slide in a direction toward the top 20 of the body 14. As the upper retractable arm 24 slides in a direction towards the top 20 of the body 14, the segment 30 slides into the segment 28, and the segment 28 slides into the open upper portion 32 of the body 14 until the trigger mechanism locks the upper retractable arm 24 in the storage position.

Similarly, the lower retractable arm 26 may be returned to the storage position by pressing on the lower retractable arm 26 to compress the lower compressible biasing means. Compressing the lower compressible biasing means causes the lower retractable arm 26 to slide in a direction toward the body 14. As the lower retractable arm 26 slides in a direction towards the bottom 22 of the body, the segment 40 slides into the segment 38, and the segment 38 slides into the open lower portion 44 in the body 14 until the trigger mechanism locks the lower retractable arm 26 in the storage position.

The upper and lower retractable arms 24, 26 may be returned to the storage position by alternately pressing on the upper and lower retractable arms 24, 26, or by concurrently pressing on the upper and lower retractable arms 24, 26.

The terms top, bottom, upper, lower, horizontal, and vertical are utilized generally to refer to the orientation of the beverage can handle 10 when assembled for use, as shown in FIG. 1 and FIG. 2.

Figure 3:
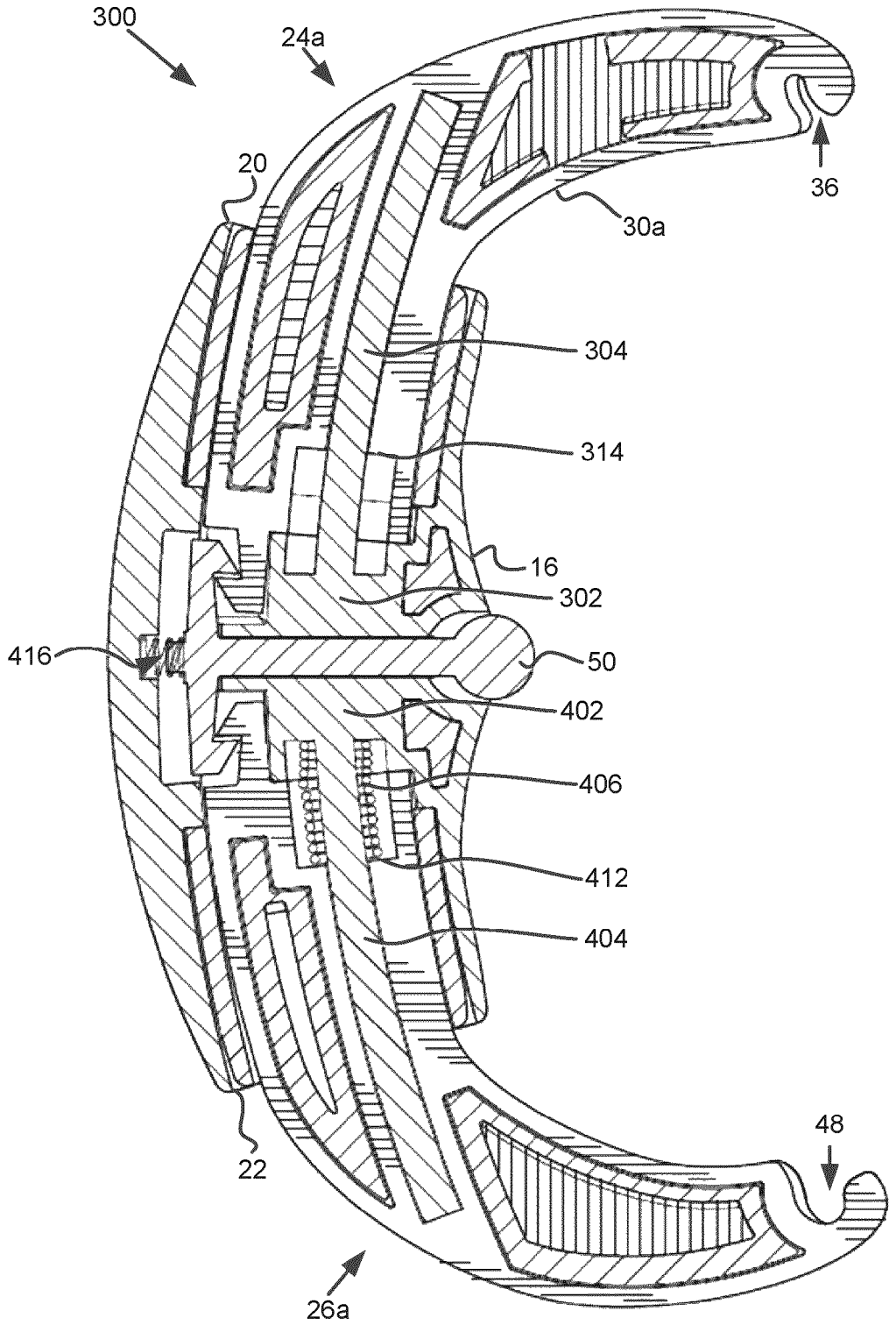
FIG. 3 is a partially cut away side view of the beverage can handle in accordance with another embodiment, in which the beverage can handle is in a storage position.
Figure 4:
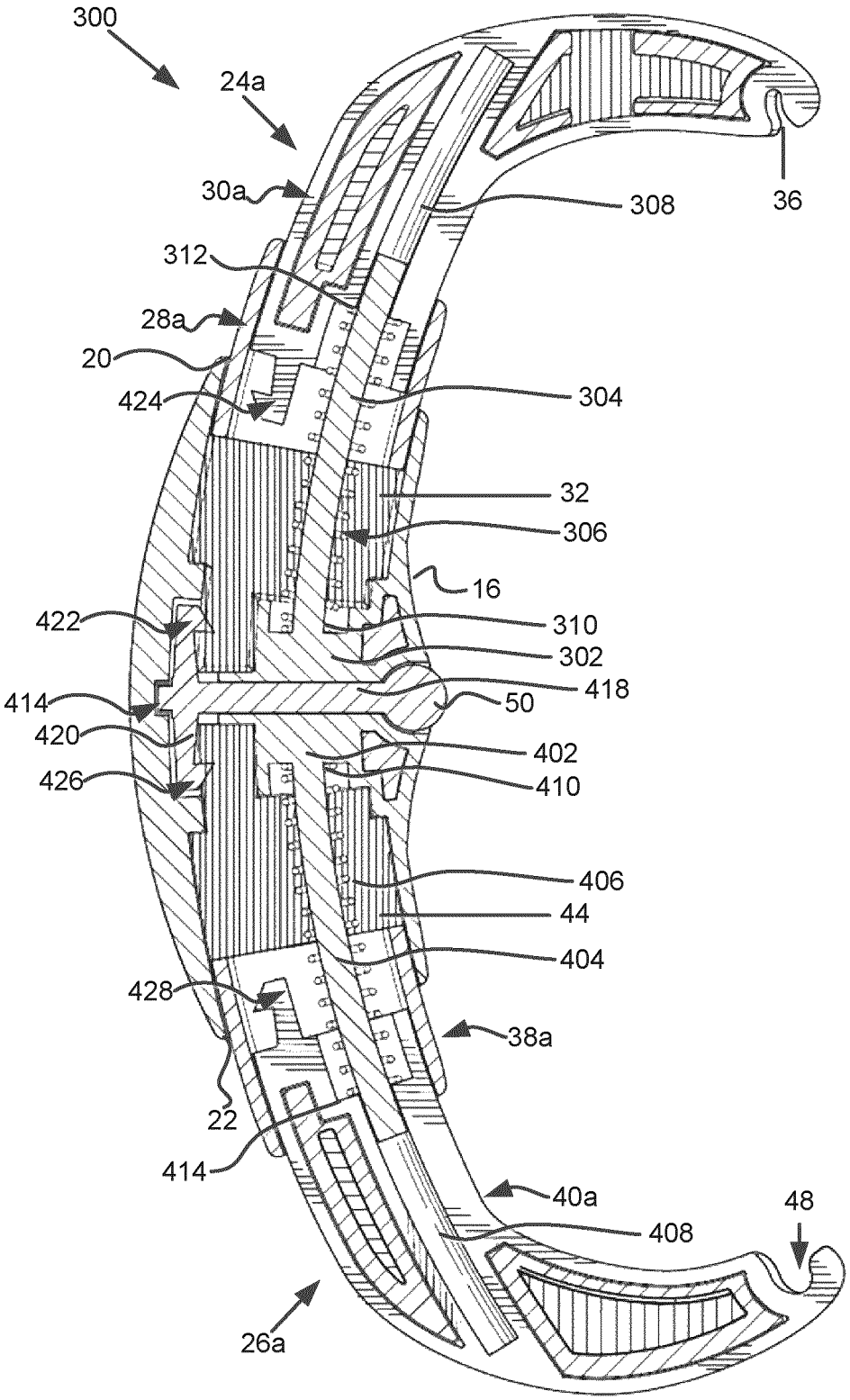
FIG. 4 is a partially cut away side the beverage can handle of FIG. 3, in which the beverage can handle is in an extended position.

Referring to FIG. 3 and FIG. 4, partially cut away side views of another example embodiment of a beverage can handle is shown. The beverage can handle 300 shown in FIG. 3 and FIG. 4 is the same as the beverage can handle 10 shown in FIG. 1 and FIG. 2, except for the upper and lower retractable arms. In the embodiment shown in FIG. 3 and FIG. 4, the segment 30*a* of the upper retractable arm 24*a* is a single part having a uniform width. Also, a segment 40*a* of the lower retractable arm 26*a* is a single part having a uniform width. In contrast, in the embodiment shown FIG. 1 and FIG. 2, the segment 30 of the upper retractable arm 24 has two parts that are fixed together and do not move relative to each other. Similarly, the segment 40 of the lower retractable arm 26 has two parts that are fixed together and do not move relative to each other.

Referring again to FIG. 3 and FIG. 4, the upper compressible biasing means includes an upper base 302, an upper projection or channel guide 304, and an upper compression spring 306. The upper projection or channel guide 304 extends from the upper base 302 through the open upper portion 32 of the body 14, through the segment 28*a*, and into an upper channel 308 formed in the upper segment 30*a* of the upper retractable arm 24*a*. The upper projection or channel guide 304 has a cross-sectional shape that is sized to closely fit within the correspondingly shaped upper channel 308 to minimize the lateral (i.e., horizontal) deflection of the upper retractable arm 24*a* when the upper retractable arm 24*a* slides from the storage position (FIG. 3) to the extended position (FIG. 4), and slides back to the storage position (FIG. 3) from the extended position (FIG. 4). The upper projection or channel guide 304 has a generally arcuate shape that corresponds with the shape of the upper retractable arm 24*a*.

The upper compression spring 306 is coiled around the upper projection or channel guide 304 so that a path of travel of the upper compression spring 306 follows a path of travel of the upper retractable arm 24*a*. A lower end 310 of the upper compression spring 306 is seated on the upper base 302. An upper end 312 of the upper compression spring 306 is seated against a surface 314 of the segment 30*a* of the upper retractable arm 24*a*.

Similarly, the lower compressible biasing means includes a lower base 402, a lower projection or channel guide 404, and a lower compression spring 406. The lower projection or channel guide 404 extends from the lower base 402 through the open lower portion 44 of the body 14, through the segment 38*a*, and into an lower channel 408 formed in the lower segment 40*a* of the lower retractable arm 26*a*. The lower projection or channel guide 404 has a cross-sectional shape that is sized to closely fit within the correspondingly shaped lower channel 408 to minimize the lateral (i.e., horizontal) deflection of the lower retractable arm 26*a* when the lower retractable arm 26*a* slides from the storage position (FIG. 3) to the extended position (FIG. 4), and slides back to the storage position (FIG. 3) from the extended position (FIG. 4). The lower projection or channel guide 404 has a generally arcuate shape that corresponds with the shape of the lower retractable arm 26*a*.

The lower compression spring 406 is coiled around the lower projection 404 so that a path of travel of the lower compression spring 406 follows a path of travel of the lower retractable arm 26*a*. An upper end 410 of the lower compression spring 406 is seated on the lower base 402. A lower end 412 of the lower compression spring 306 is seated against a surface 412 of the segment 40*a* of the lower retractable arm 26*a*.

In the embodiment shown in FIG. 3 and FIG. 4, the trigger mechanism is a push-to-release trigger mechanism. The push-to-release trigger mechanism includes a T-shaped member 414 that is disposed within the body 14 and moveable from an engaged position to disengaged position by a biasing means 416. The biasing means 416, for example a spring, biases the T-shaped member 414 into the engaged position.

The T-shaped member 414 has a horizontal portion 418 and a vertical portion 420. The depressible button 50 extends from the horizontal portion 418. The vertical portion 420 has an upper hook 422 that is shaped and dimensioned to releasably engage with an upper hook 424 that extends from the segment 30*a* of the upper retractable arm 24*a* in a direction towards the top 20 of the body 14. The vertical portion 420 also has a lower hook 426 that is shaped and dimensioned to releasably engage with a lower catch 428 that extends from the segment 40*a* of the 14 of the lower retractable arm 26*a* in a direction towards the bottom 22 of the body 14.

When the depressible button 50 is pressed, for example, by an index finger of a user, the biasing means 416 compresses and the T-shaped member 414 moves in a horizontal direction towards the back 18 of the body 14 until the trigger mechanism actuates. When the trigger mechanism actuates, the upper and lower hooks 422, 426 disengage from the upper and lower catches 424, 428, respectively, which causes the upper and lower compressible biasing means to decompress. The decompression of the upper and lower compressible biasing means causes both the upper and lower retractable arms 24*a*, 26*a* to slide into the extended position, as shown in FIG. 4.

Figure 5:
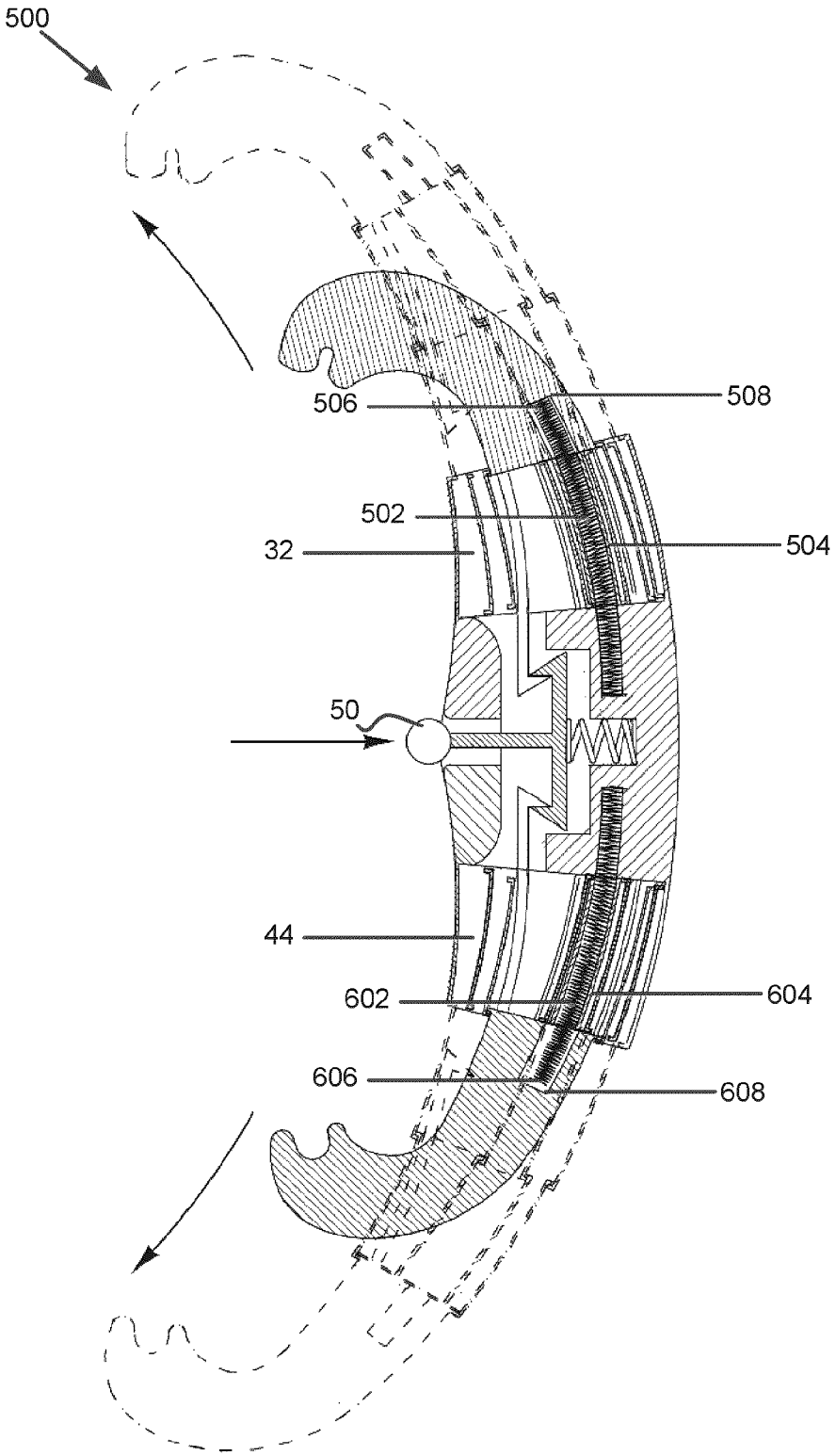
FIG. 5 is a partially cut away side view of the beverage can handle in accordance with another embodiment, in which the beverage can handle is in a storage position.
Figure 6:
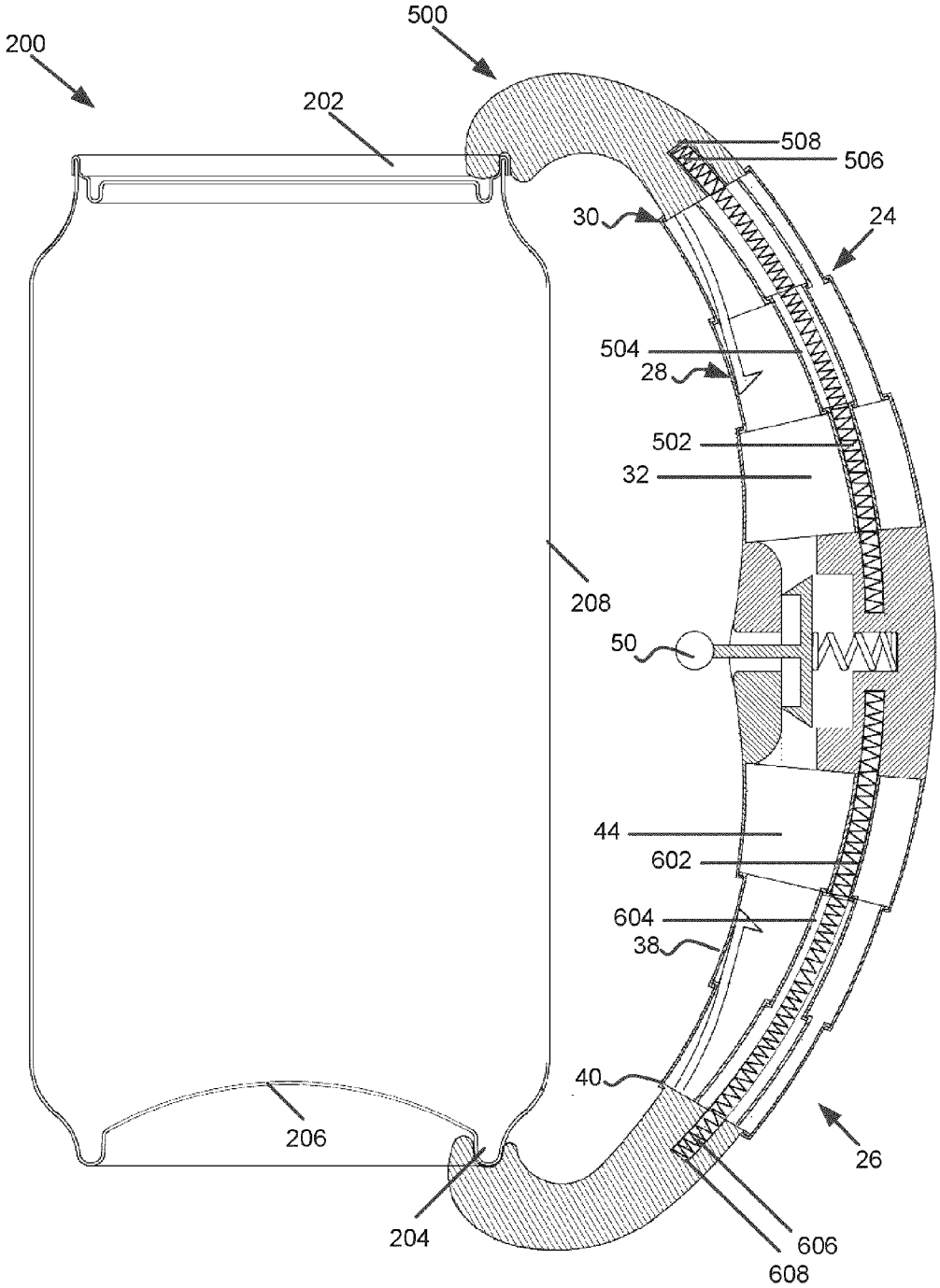
FIG. 6 is a partially cut away side the beverage can handle of FIG. 5, in which the beverage can handle is in an extended position.

Referring to FIG. 5 and FIG. 6, partially cut away side views of another example embodiment of a beverage can handle is shown. The beverage can handle 500 shown in FIG. 5 and FIG. 6 is the same as the beverage can handle 10 shown in FIG. 1 and FIG. 2.

In the embodiment shown in FIG. 5 and FIG. 6, the upper compressible biasing means includes an upper compression spring 502 that is disposed in the body 14 of the grip 12. The upper compression spring 502 extends in a direction towards the top 20 of body 14 and into a first set of nested channels 504 formed in the open top portion 32 of the body 14, and in the nested segments 28, 30 of the upper retractable arm 24. An upper end 506 of the upper compression spring 504 abuts or is seated against a surface 508 at the end of the first set of nested channels 504.

The lower compressible biasing means includes a lower compression spring 602 that is disposed in the body 14 of the grip 12. The lower compression spring 602 extends in a direction towards the bottom 22 of body 14 and into a second set of nested channels 604 formed in the open lower portion 44 of the body, and in the nested segments 38, 40 of the lower retractable arm 26. A lower end 606 of the lower compression spring 604 abuts or is seated against a surface 608 at the end of the second set of nested channel 604.

The trigger mechanism in the embodiment shown in FIG. 5 and FIG. 6 is similar to the trigger mechanism in FIG. 3 and FIG. 4, and thus is not described in detail again.

Figure 7:
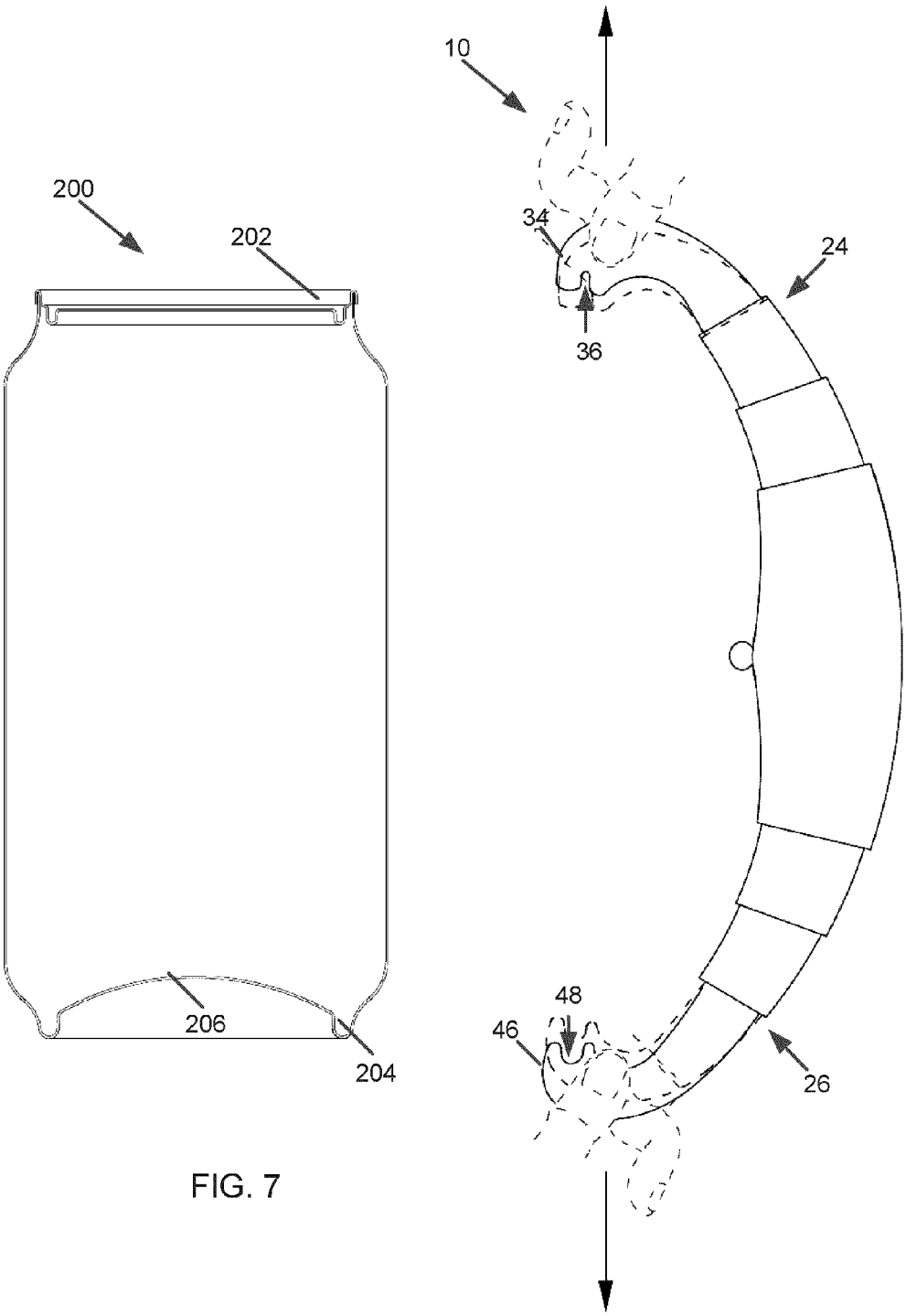
FIG. 7 is a side view of the beverage can handle of any previous embodiment, showing how to flex the upper and lower arms of the beverage can handle for attachment of the beverage can handle to a beverage can.
Figure 8:
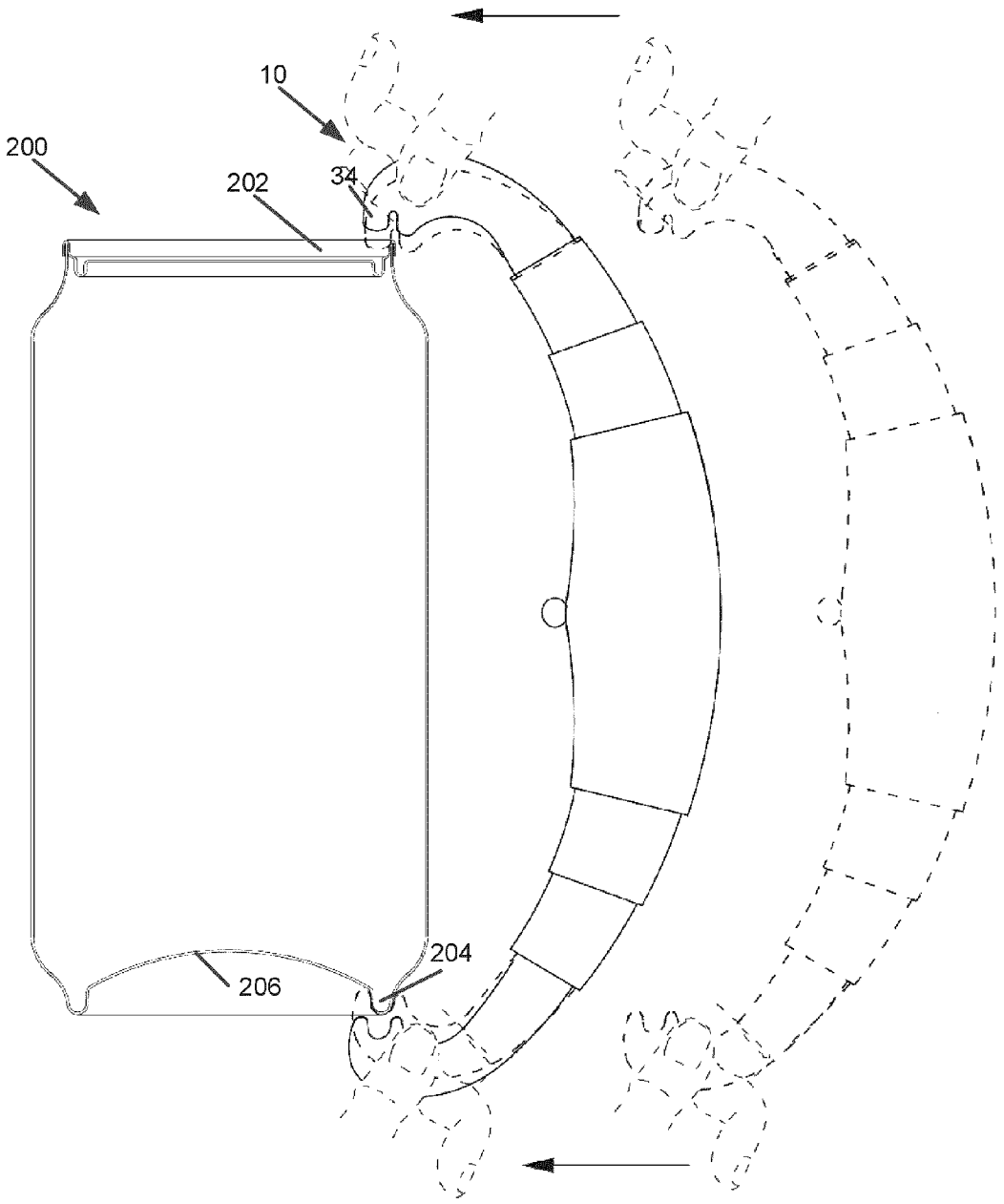
FIG. 8 is a side view of the beverage can handle of any previous embodiment, showing the flexed, extended handle being placed near the top and bottom lips of a beverage can.
Figure 9:
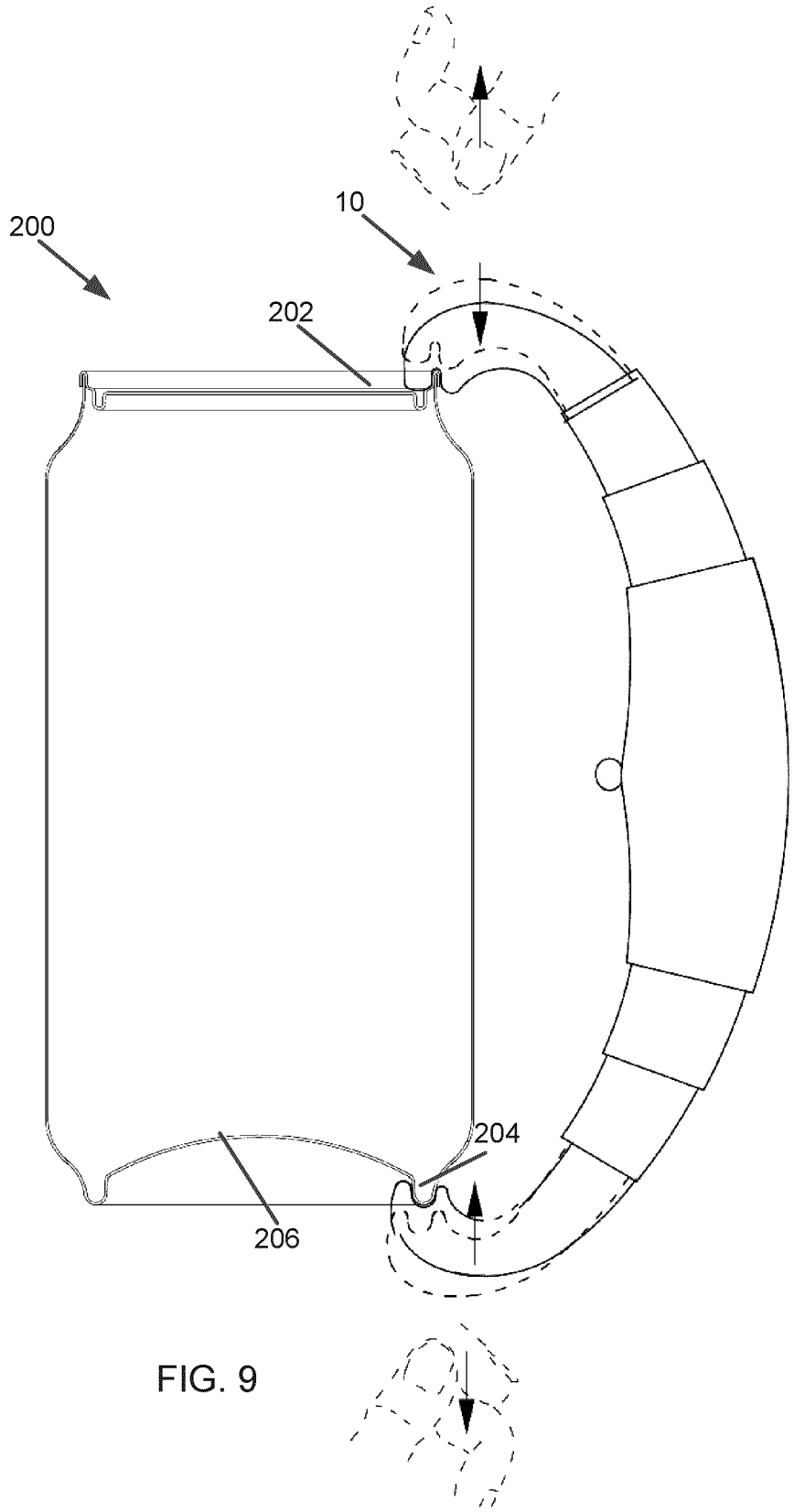
FIG. 9 is a side view of the beverage can handle of FIG. 2, showing the flexed handle being mated with, and released from, a beverage can.
Figure 10A:
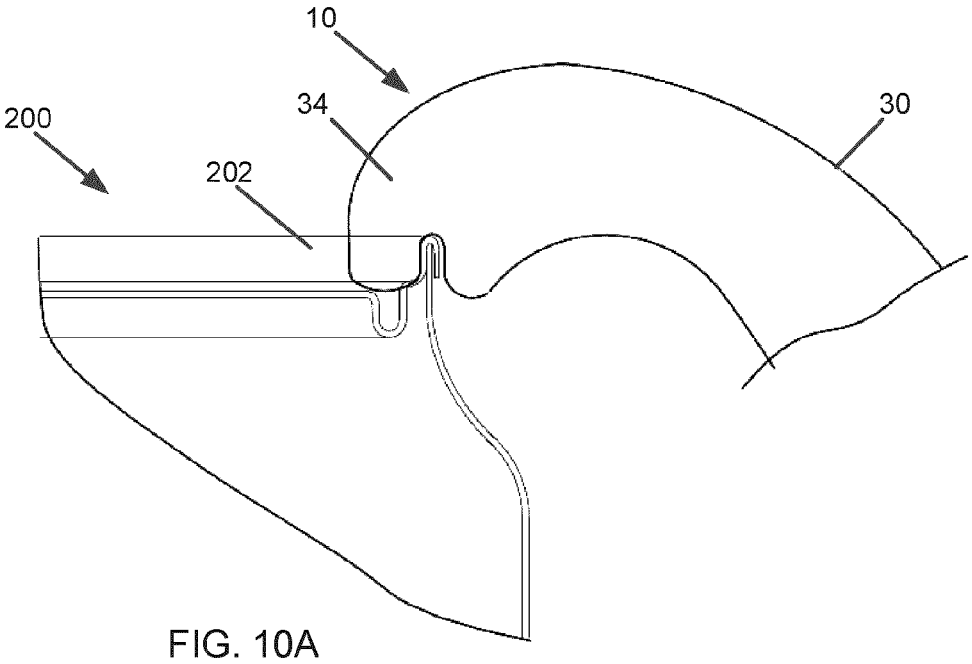
FIG. 10A is a zoomed in side view of the beverage can handle of any previous embodiment, mated with the top lip of the beverage can.
Figure 10B:
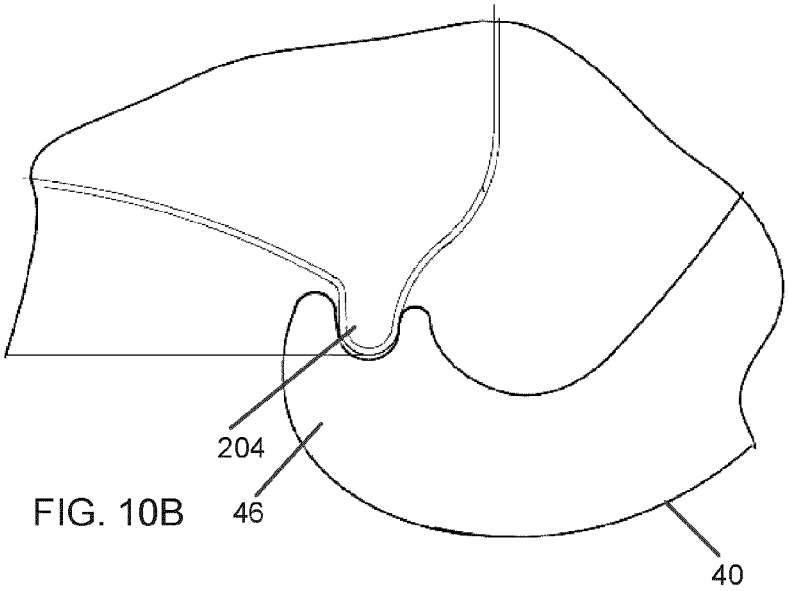
FIG. 10B is zoomed in side view of the beverage can handle of any previous embodiment, mated with the bottom lip of the beverage can.
Figure 11:
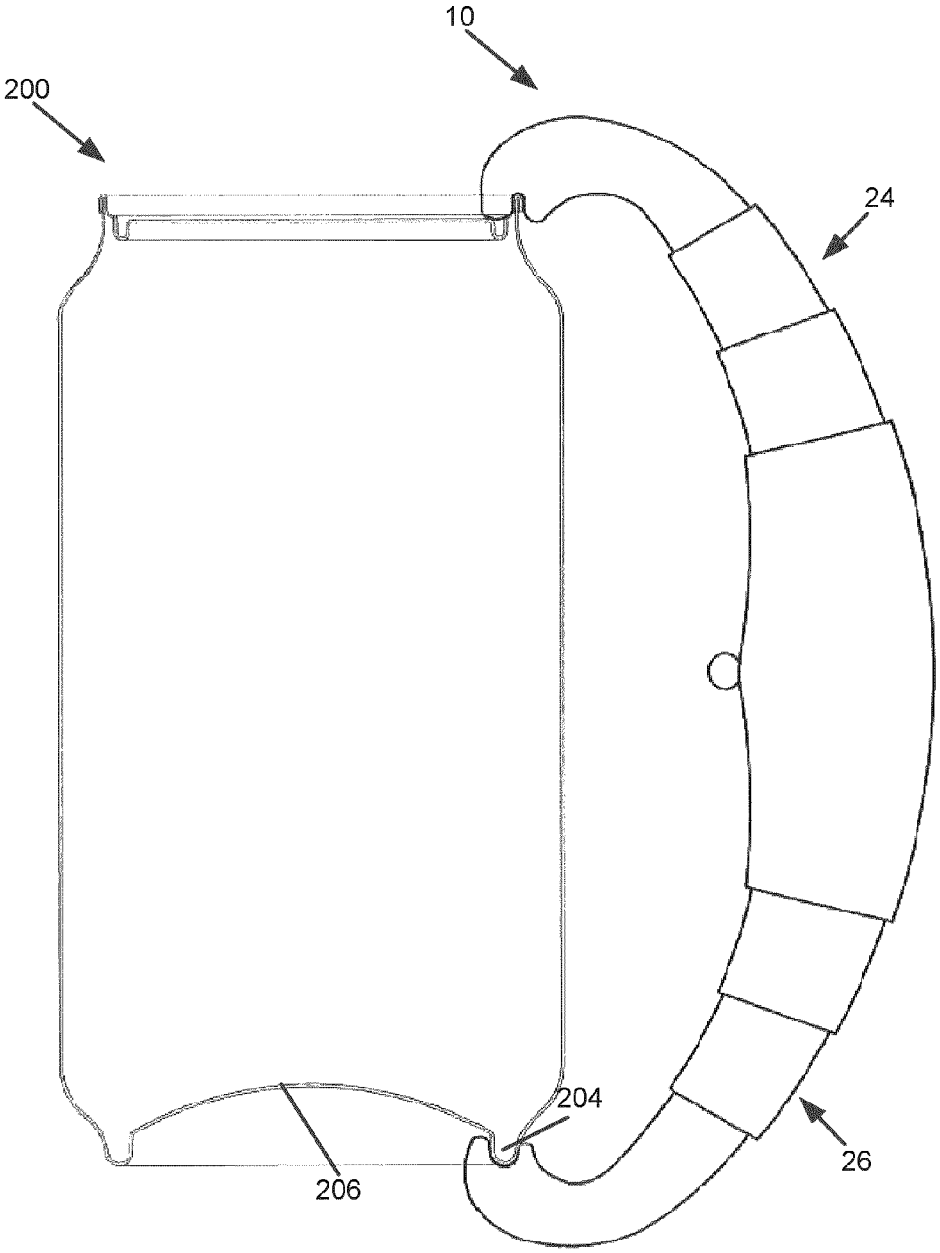
FIG. 11 is a side view of the beverage can handle of FIG. 2, showing the handle attached to the beverage can.

The attachment of the beverage can handle 10, or any previous embodiment, to a beverage can 200 will now be described with reference to FIG. 7, FIG. 8, FIG. 9, FIG. 10A, FIG. 10B, and FIG. 11. For example, when the beverage can handle 10 is in the extended position, as shown in FIG. 7, the beverage can handle 10 may be attached to the beverage can 200. The upper retractable arm 24 may be attached to the top lip or rim 202 of the beverage can 200 by pulling on the upper end 34 of the upper retractable arm 24 in a direction towards the top rim 202 of the beverage can 200 (FIG. 7), and snapping the groove 36 onto the top lip or rim 202 to mate the groove 36 with the top lip or rim 202, as shown in FIG. 8, FIG. 9, and FIG. 10A. The lower retractable arm 26 may also be attached to the beverage can by pulling on the lower end 46 of the lower retractable arm 26 in a direction towards the base 206 of the beverage can 200 (FIG. 7), and snapping the groove 48 onto the protrusion 204 to mate the groove 48 with the protrusion 204, as shown in FIG. 8, FIG. 9, and FIG. 10B. When the beverage can handle 10 is attached to the beverage can 200 (FIG. 11), pressure on the lip 202 and the protrusion 204 enables the beverage can handle 10 to maintain a stable grip on the beverage can 200 to inhibit or minimize slippage or rolling of the beverage can 200.

In an embodiment, when the beverage can handle 10 is in the extended position, the height of the beverage can handle 10 may be less than a height of the beverage can 200. Thus, the upper and lower retractable arms 24, 26 may be flexed to stretch the beverage can handle 10 (FIG. 8) to facilitate attachment of the upper and lower retractable arms 24, 26 to the beverage can 200.

Figure 12:
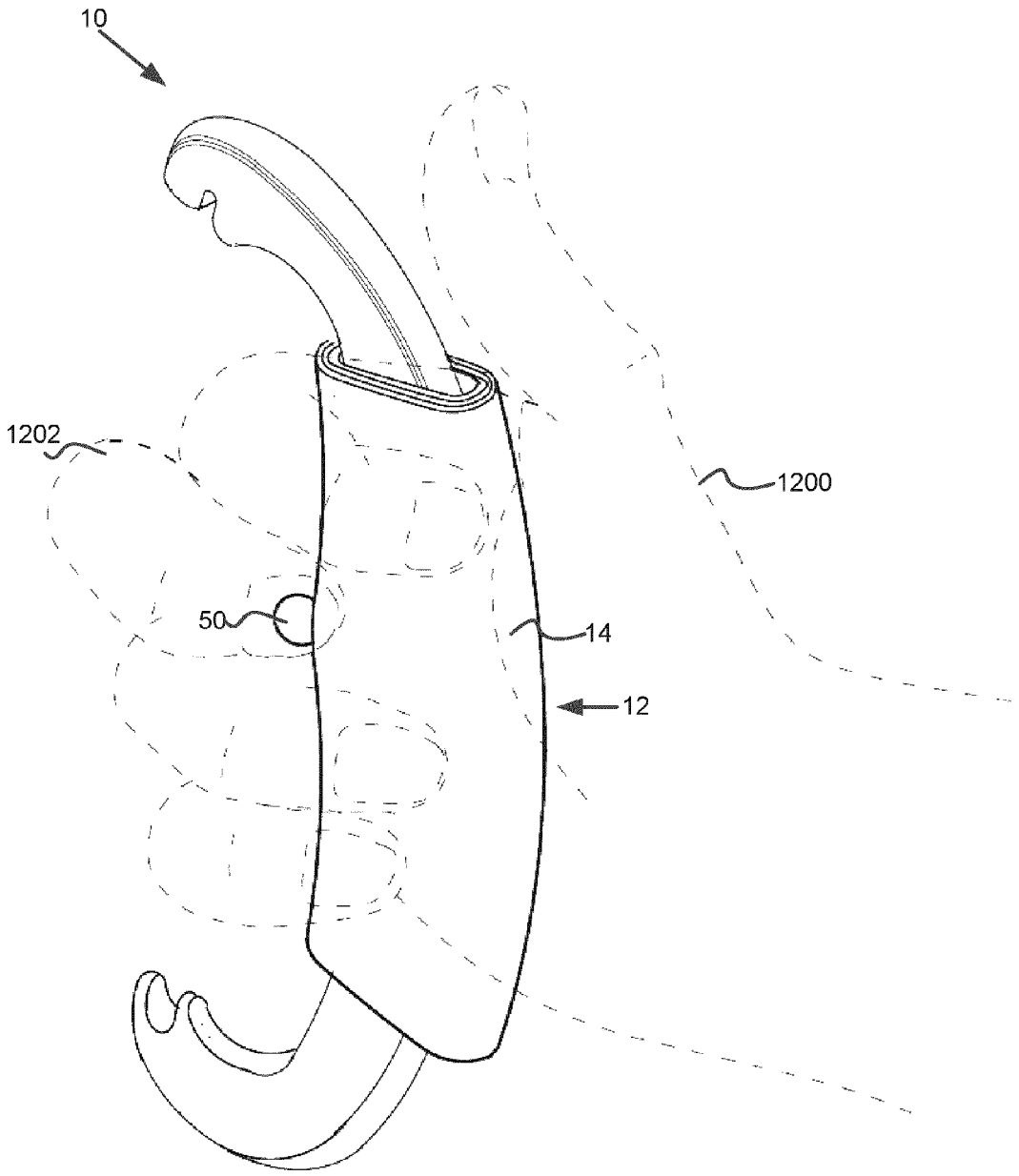
FIG. 12 is a perspective view of the beverage can handle of FIG. 1.

FIG. 12 shows the beverage can handle 10 of FIG. 1, in a storage position, with a hand 1200 of a user gasping the body 14 of grip 12 of the beverage can handle 10. An index finger 1202 of the user's hand 1200 is placed on the depressible button 50, and the trigger mechanism is not actuated.

Figure 13:
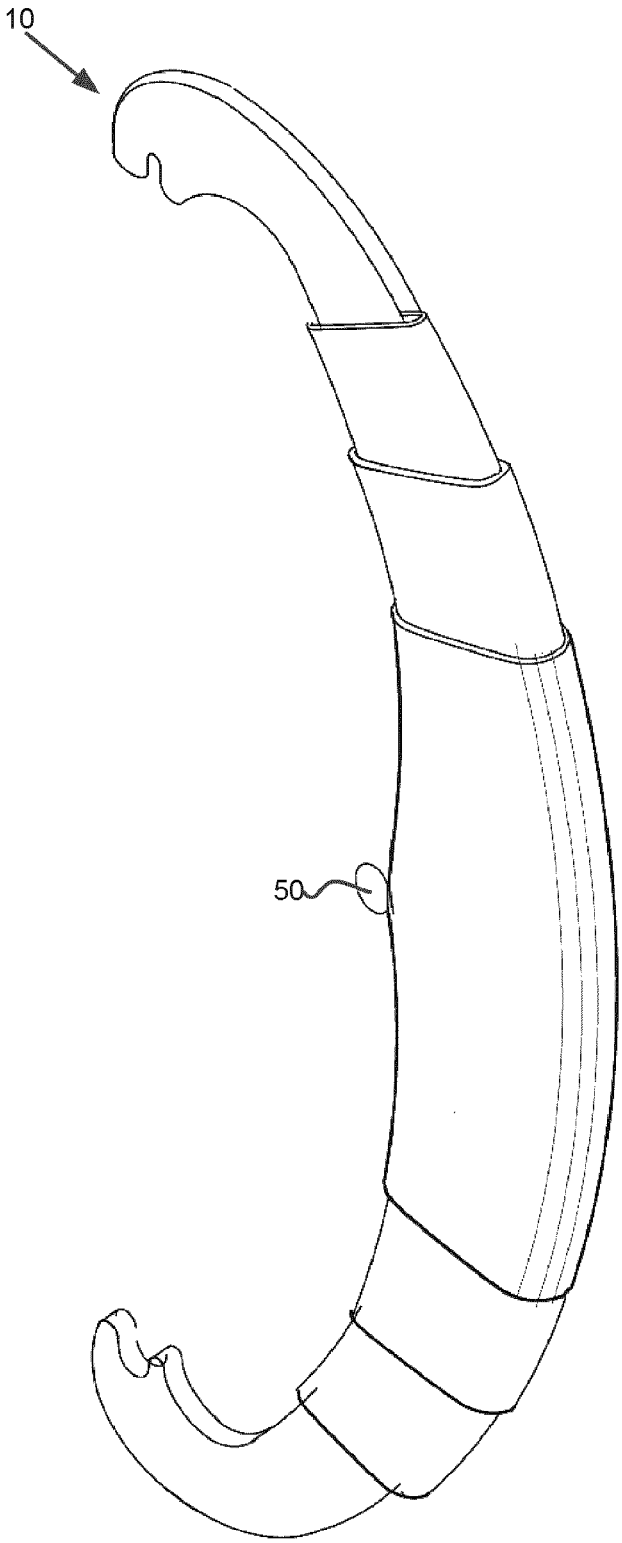
FIG. 13 is a perspective view of the beverage can handle of FIG. 2.

FIG. 13 shows the beverage can handle 10 of FIG. 2, in the extended position after the trigger mechanism is actuated by a user pressing on the depressible button 50.

Figure 14:
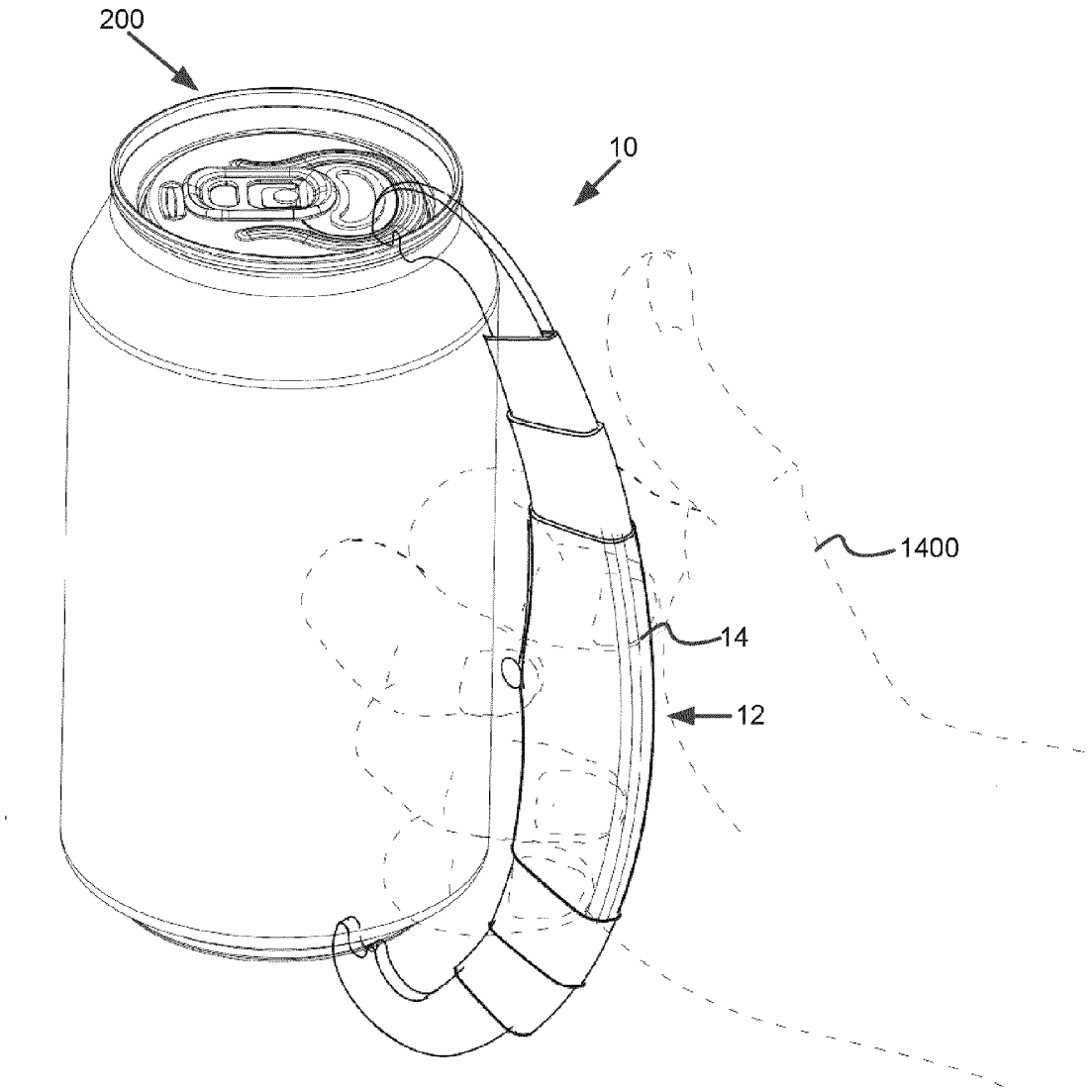
FIG. 14 is a perspective view of the beverage can handle of FIG. 2, in the extended position, attached to a beverage can.

FIG. 14 shows a perspective view of the beverage can handle 10 of FIG. 1, attached to a beverage can 200, with a user's hand 1400 grasping and holding the body 14 of the grip 12 of the beverage can handle 10.

Figure 15:
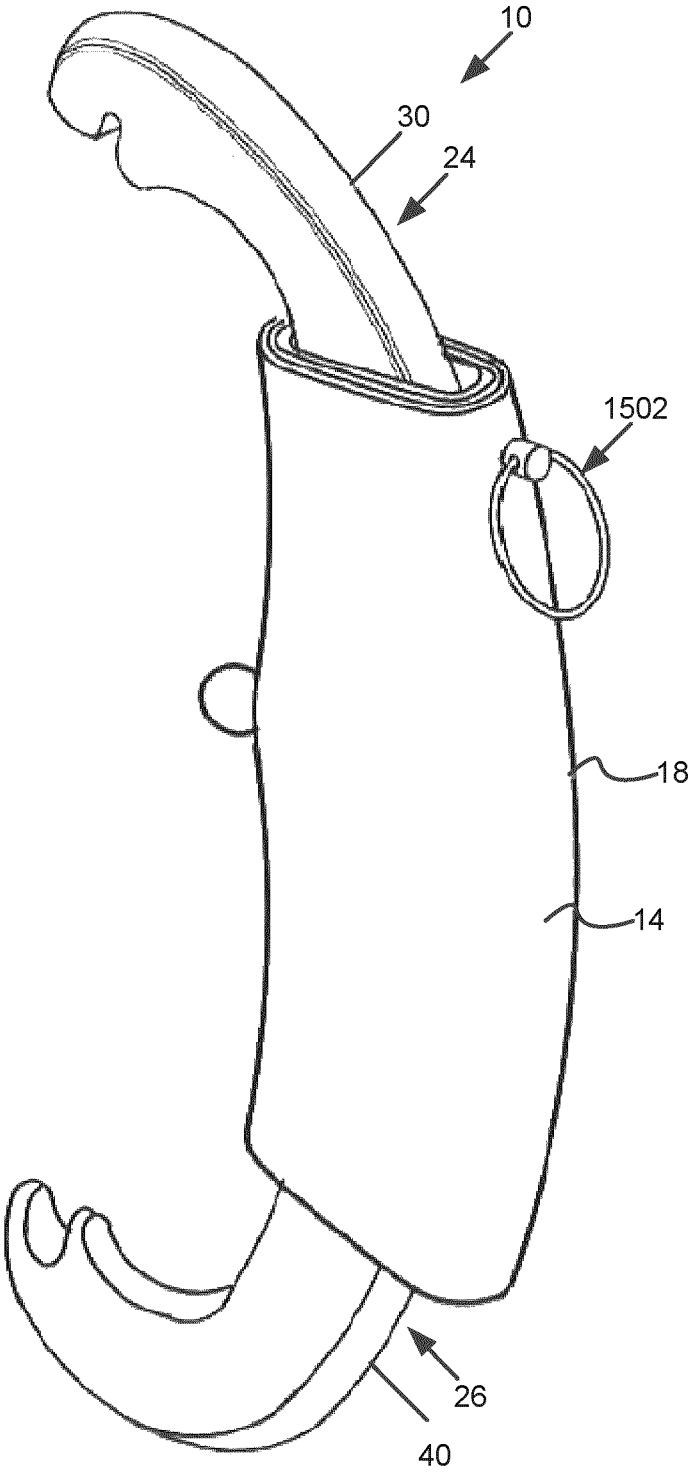
FIG. 15 is a perspective view of a beverage can of FIG. 1, in which the beverage can handle is in the storage position and a key ring is attached to the beverage can handle.

FIG. 15 shows a perspective view of the beverage can handle 10, in which the back 18 of the body 14 has a ring 1502 for attachment to a key ring or key chain. The ring 1502 is disposed in an aperture in the back 18 of the body 14 and positioned such that the ring 1502 does not interfere with the grasping and holding of the body 14 of the grip 12 by a user. In an alternative embodiment, a back surface of the segment 30 of the upper retractable arm 24 may have a ring for attachment to a key ring or key chain. In an alternative embodiment, a back surface of the segment 40 of the lower retractable arm 26 may have a ring for attachment to a key ring or key chain.

Figure 16:
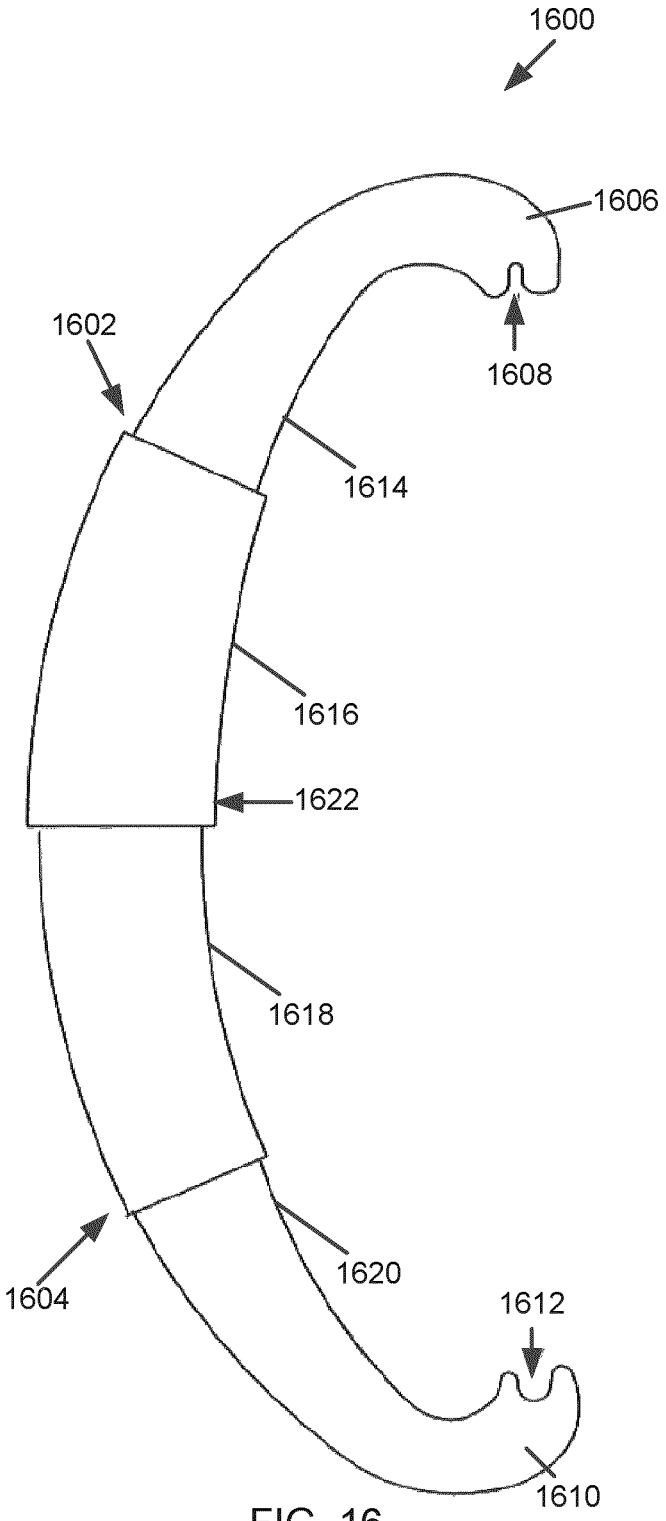
FIG. 16 is a side view of a beverage can handle in accordance with another embodiment, in which the beverage can handle is in an extended position.

FIG. 16 shows a side view of a beverage can handle according to another embodiment of the present disclosure. The beverage can handle 1600 has an upper arm 1602 and a lower retractable arm 1604. An upper end 1606 of the upper arm 1602 has a groove 1608 that is sized and shaped for releasably mating with and supporting a top lip or rim 202 of a beverage can 200. A lower end 1610 of the lower retractable arm 1604 also has a groove 1612 that is sized and shaped for releasably mating with a projection 204 extending in a direction away from a base 206 of a beverage can 200. The upper end 1606 of the upper arm 1602 and the lower end 1610 of the lower arm 1604 each have a width (not shown) that is sufficient to inhibit rolling of a beverage can 200 when the beverage can handle 1600 is attached to a beverage can 200 and tilted for drinking.

The upper arm 1602 has two parts 1614, 1616 that are fixed together and do not move relative to each other. Similarly, the lower retractable arm 1604 has two parts 1618, 1620 that are fixed together and do not move relative to each other. The part 1618 of the lower retractable arm 1604 is nested or housed within the part 1616 of the upper arm 1604. The part 1618 of the lower retractable arm 1604 slides relative to the part 1616 of the upper arm 1604 from a storage position to an extended position.

The part 1616 of the upper arm 1602 may have an internal flange (not shown) and the part 1618 may also have an internal flange (not shown) for abutting against the internal flange (not shown) of the part 1616 to stop the travel of the part 1618 of the lower retractable arm 1604 when the lower retractable arm 1604 slides in a direction away from the upper arm 1602.

The upper and lower arms 1602, 1604 collectively may have a generally arcuate shape to form a substantially D-shaped beverage can handle 1600. The generally arcuate shape of the upper arm 1602 and the lower retractable arm 1604 provides a space between a body 208 of a beverage can 200 and a back surface 1622 of the parts 1616, 1618 of the upper and lower arms 1602, 1604 when the lower retractable arm 1604 is in the extended position, for clearance of a user's fingers when grasping the parts 1616, 1618.

In an embodiment, when the lower retractable arm 1604 is in the extended position, the height of the beverage can handle 1600 may be less than a height of the beverage can 200. Thus, the lower retractable arm 1604 may be flexed to stretch the beverage can handle 1600 to facilitate attachment of the lower end 1610 of the lower retractable arm 1604 onto the beverage can 200. The lower retractable arm 1604 may also be flexed to provide a tight fit between the groove 1612 and a protrusion 204 extending in a vertical direction away from a base 206 of the beverage can 200.

The operation of the beverage can handle 1600 will now be described with reference to FIG. 16. For the following description, the upper and lower arms 1602, 1604 are assumed to begin in the storage position, similar to the embodiment shown FIG. 1. However, unlike the beverage can handle 10 shown in FIG. 1, the beverage can handle 1600 does not include a depressible button 50 or a trigger mechanism.

To attach the beverage can handle 1600 to a beverage can 200, a user first attaches the upper arm 1602 to the top lip or rim 202 of the beverage can 200 by pressing on the upper end 1606 of the upper arm 1602 to snap the groove 1606 onto the top lip or rim 202 of the beverage can 200 to mate the groove 1606 with the top lip or rim 202 of the beverage can 200. A user may then grasp on the lower end 1610 of lower retractable arm 1604 and pull on the lower end 1610 of the lower retractable arm 1604 in a direction away from the upper arm 1602. This causes the lower retractable arm 1604 to slide, in a direction away from the upper arm 1602, from the storage position to the extended position.

When the lower arm 1604 is in the extended position, as shown in FIG. 16, the lower retractable arm 1604 may be flexed by pulling on the lower end 1610 of the lower retractable arm 1604 in a direction away from the base 206 of the beverage can 200 to place the groove 1612 over the protrusion 204. Once the groove 1612 is over the protrusion 204, the lower end 1610 of the lower arm 1604 is attached to the beverage can 200 by pulling on the lower end 1610 of the lower retractable arm 1604 in a direction towards the base 206 to snap the groove 1612 onto the protrusion 204 to mate the groove 1612 with the protrusion 204.

When the beverage can handle 1600 is attached to the beverage can 200, pressure on the lip 202 and the protrusion 204 due to flexing of the lower arm 1604 enables the beverage can handle 1600 to maintain a stable, tight grip on the beverage can 200 to inhibit or minimize slippage or rolling of the beverage can 200. Also, when the beverage can handle 1600 is attached to the beverage can 200, a user may grasp the parts 1616, 1618 of the upper and lower arms 1602, 1604 and tilt the beverage can handle 1600 to drink a beverage from the beverage can 200.

A user may detach the beverage can handle 1600 from the beverage can 200 by pulling on the lower end 1610 of the lower retractable arm 1604 in a direction away from the base 206 of the beverage can 200 to detach the groove 1612 from the protrusion 204. Once the groove 1612 is detached from the protrusion 204, the user may then push on the lower end 1610 of the lower retractable arm 1604 in a direction towards the upper arm 1602 to slide the lower arm 1604 back into the storage position. After the lower retractable arm 1604 is in the storage position, the upper arm 1602 may then be detached from the beverage can 200 by pulling on the upper end 1606 of the upper arm 1602 until the groove 1608 detaches from the top rim or lip 202 of the beverage can 200.

In an alternative embodiment, the part 1618 of the lower retractable arm 1602 may be connected to the part 1616 of the upper arm 1604 by a tension biasing means (not shown), such as, for example, a tension spring. The tension biasing means holds the lower a retractable arm 1604 in the storage position. Also, when the lower retractable arm 1604 is in the extended position, the tension biasing means pushes or forces the lower arm 1604 to slide in a direction towards the upper arm 1602 to return the lower retractable arm 1604 to the storage position. In this alternative embodiment, when the beverage can handle 1600 is in the extended position and attached to a beverage can 200, as described above, and the groove 1612 is detached from the protrusion 204 of the beverage can 200, the tension biasing means pushes or forces the lower retractable arm 1604 to slide into the storage position.

Advantageously, the upper and lower arms of the beverage can handle described herein are retractable or collapsible to provide a much more desirable, compact sized beverage can handle which may fit into a user's pocket, or hang from a user's your key chain. The compact size of the beverage can handle when the upper and lower arms are retracted facilitates the placement of the handle in known beverage packaging.

The described embodiments are to be considered in all respects only as illustrative and not restrictive. The scope of the claims should not be limited by the preferred embodiments set out, but should be given the broadest interpretation consistent with the description as a whole. All changes that come with meaning and range of equivalency of the claims are to be embraced within their scope.

The invention claimed is:

1. A beverage can handle comprising:

a first arm having a first end and a second end, the first end including a protrusion for supporting a first lip of a beverage can and shaped for inhibiting slippage of the first lip of the beverage can off of the protrusion; and a second arm slideably coupled to the first arm and extendable from a storage position to an extended position relative to the first end of the first arm, the second arm having a first end and a second end, the first end comprising a groove for releasably mating with a second lip of the beverage can when in the extended position and shaped for inhibiting slippage of the second lip of the beverage can out of the groove, wherein the first arm includes a body and a first retractable arm and the first retractable arm is configured to slide into the body and the second arm is a second retractable arm configured to slide into the body, and wherein the first retractable arm includes a first catch and the second retractable arm includes a second catch and the body includes a locking means, the first and second retractable arms being maintained in the retracted position when the first and second catches are engaged with the locking means, and the first and second retractable arms being extendable to the extended position when the first and second catches are disengaged from the locking means.

2. The beverage can handle of claim 1, wherein the locking means includes a trigger mechanism and a movable bar with two ends each comprising a hook, each hook for releasably engaging with the first and second catches on the first and second retractable arms, wherein when the trigger mechanism is actuated, the catches are released, allowing the retractable arms to be extended into the extended position.

3. The beverage can handle of claim 1, wherein the body and the retractable arms contain a biasing means for forcing the retractable arms away from the body after release of the trigger mechanism.

4. The beverage can handle of claim 3, wherein the biasing means is a spring.

5. The beverage can handle of claim 3, wherein the biasing means is a first biasing means and the body contains a second biasing means that for holding the movable bar in a locked position to prevent the trigger mechanism from actuating without pressure.

6. A beverage can handle comprising a body having a trigger mechanism, a first retractable arm, connected to the body by nested segments arranged in a telescopic configuration, and slideable from a storage position, away from the body into an extended position when the trigger mechanism is actuated, having a groove for releasably mating with the first lip of the beverage can;

a second retractable arm, connected to the body by nested segments arranged in a telescopic configuration, and slideable from a storage position, away from the body into an extended position when the trigger mechanism is actuated, having a groove for releasably mating with the second lip of the beverage can;

the body and the retractable arms having a biasing means for forcing the retractable arms away from the body into the extended position when the trigger mechanism is actuated.

7. The beverage can handle of claim 6, further comprising a compression bias of the groove on the first retractable arm and the groove on the second retractable arm towards each other, to ensure a tighter grip of the beverage can.

8. The beverage can handle of claim 6, with a ring connected to one of the first arm and the second arm and sized and positioned for attachment to a key ring.

9. The beverage can of claim 6, further comprising an aperture formed within one of the first arm and the second arm and sized and positioned for attachment of a key ring.

10. The beverage can of claim 6, wherein first retractable arm comprises a channel and a channel guide, and wherein the biasing means of the first retractable arm is on the channel guide, the channel being configured to receive the channel guide and the biasing means so that the channel guide and the biasing means follow a path of the channel to facilitate compression and decompression of first retractable arm.

11. The beverage can of claim 6, wherein second retractable arm comprises a channel and a channel guide, and wherein the biasing means of the second retractable arm is on the channel guide, the channel being configured to receive the channel guide and the biasing means so that the channel guide and the biasing means follow a path of the channel to facilitate compression and decompression of first retractable arm.

* * * * *